United States Patent [19]

Sherwin

[11] Patent Number: 4,510,717

[45] Date of Patent: Apr. 16, 1985

[54] LENS FINISHING APPARATUS

[75] Inventor: Dewayne J. Sherwin, Imlay City, Mich.

[73] Assignee: Coburn Optical Industries, Inc., Muskogee, Okla.

[21] Appl. No.: 450,502

[22] Filed: Dec. 16, 1982

[51] Int. Cl.[3] ..... B24B 7/00

[52] U.S. Cl. ..... 51/58

[58] Field of Search ..... 51/58, 64, 65, 60, 54

[56] References Cited

U.S. PATENT DOCUMENTS

| | | | |
|---|---|---|---|
| 761,061 | 5/1904 | Collinson | 51/64 |
| 1,609,963 | 12/1926 | Robinson | 51/65 |
| 3,389,508 | 6/1968 | Suddarth | 51/60 |
| 3,732,647 | 5/1973 | Stith | 51/54 |
| 4,085,549 | 4/1978 | Hodges | 51/58 |
| 4,135,333 | 1/1979 | Stith | 51/58 |
| 4,143,490 | 3/1979 | Wood | 51/58 |
| 4,320,599 | 3/1982 | Hill | 51/58 |

*Primary Examiner*—Harold D. Whitehead

*Attorney, Agent, or Firm*—Remy J. VanOphem

[57] ABSTRACT

Apparatus for finishing or polishing a surface of a lens with a finishing tool. The apparatus includes a main frame, a shaft pivotally mounted to the main frame, and eccentric drive means driving the shaft in a predetermined orbital motion. Lens finishing means are fixedly secured to one end of the shaft. A lens carrier is slidably mounted to the main frame such as to be reciprocable along a path perpendicular to the orbital axis of the shaft. The lens is removably mounted to the carrier and is biased by a biasing device against the lens finishing tool.

22 Claims, 10 Drawing Figures

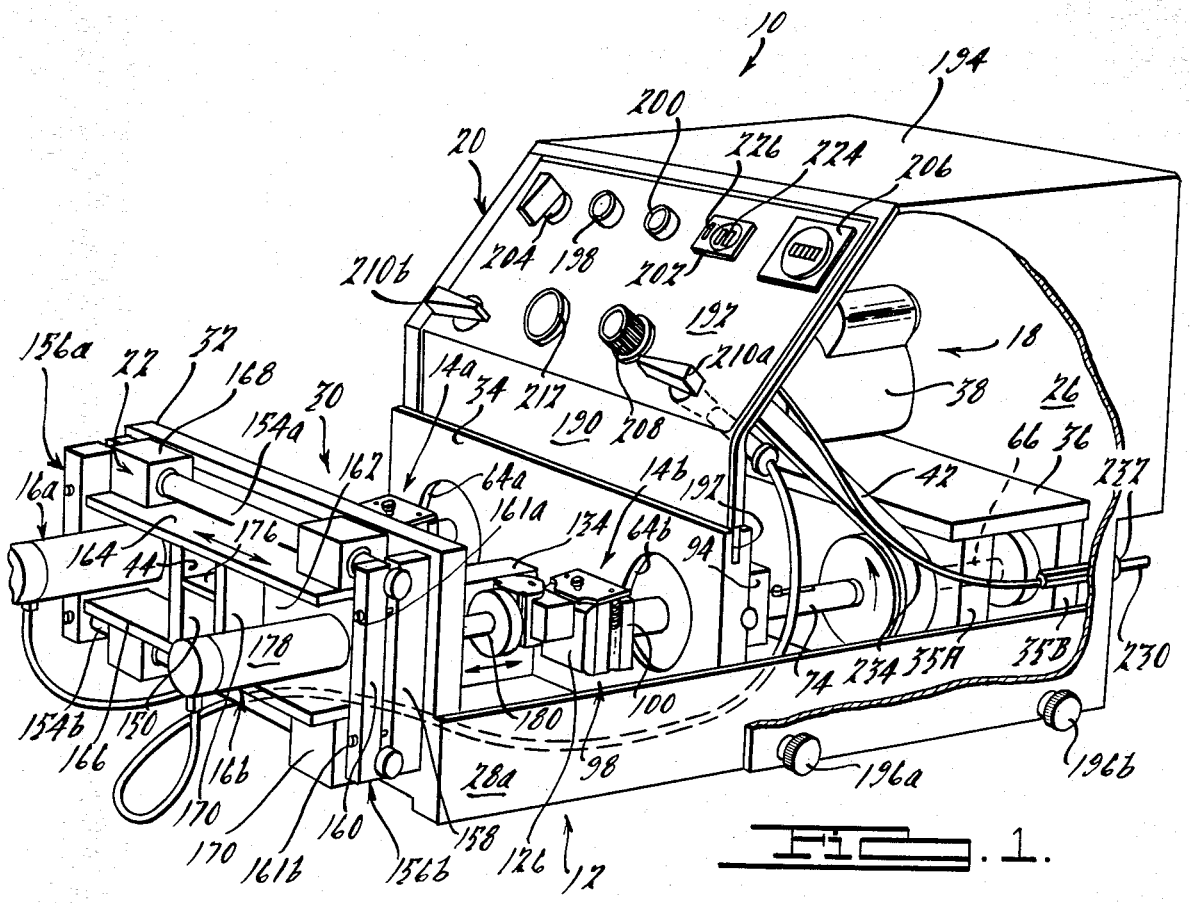
FIG. 1.
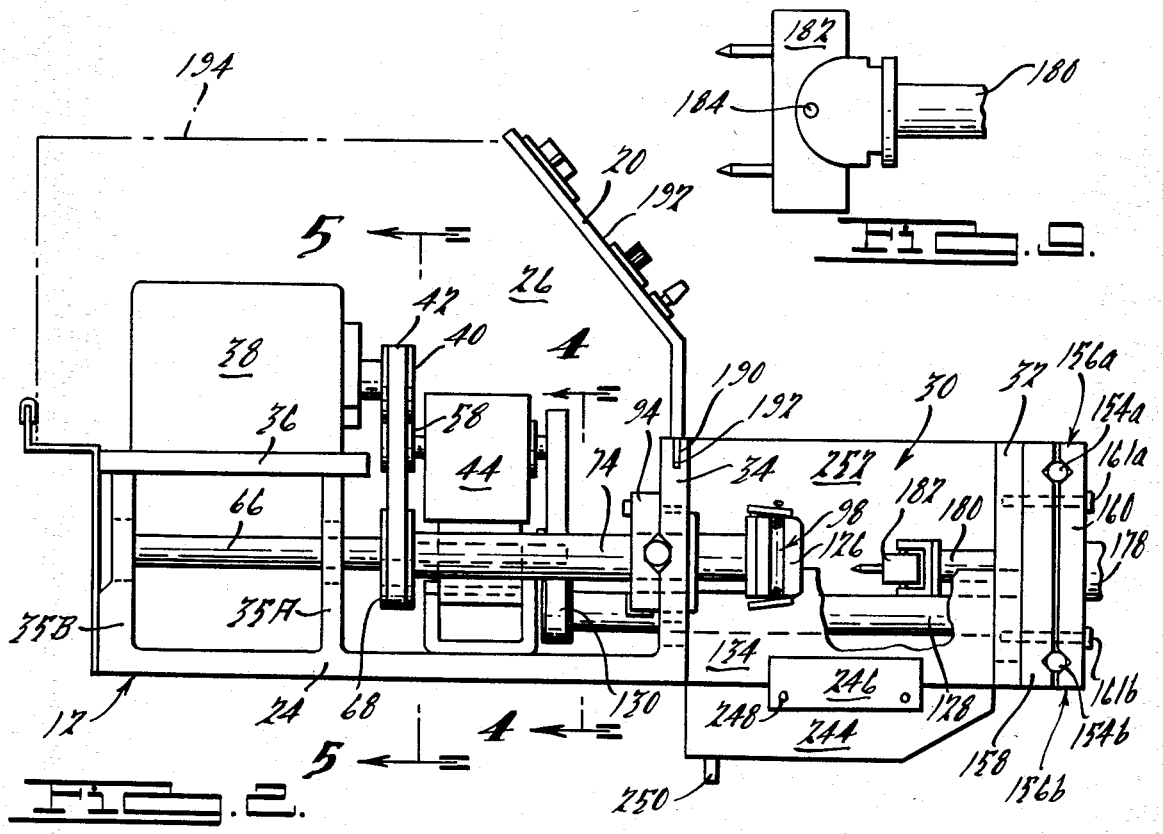
FIG. 2.
FIG. 3.

LENS FINISHING APPARATUS

BACKGROUND OF THE INVENTION

1. Field of the Invention

The present invention is directed to a lens grinding apparatus and more particularly to compact modular lens grinding apparatus for polishing and finishing of ophthalmic lenses.

2. Description of the Prior Art

Many apparatuses have been designed in the past for finishing ophthalmic lenses. In each case, a lap surface must be held in engagement with a lens surface while one or both move relative to the other in a preferred pseudo-random motion so as to smoothly finish the lens surface without causing ridges, grooves, and other aberrations on the lens surface.

The pseudo-random motion is often referred to as "break-up" motion. This motion may take a variety of forms as long as it does not change the polar alignment of the lens relative to the tool.

For example, U.S. Pat. No. 3,900,972, issued Aug. 26, 1975 to Rupp, attains this movement by coupling a polishing tool to an orbital driving means through a gimbal coupling designed such that the tool will be free to pivot about two perpendicular axes which are vertically displaced from one another relative to the lens and lap of tool surfaces. Specifically, one axis of the gimbal is spaced from the vertex of the tool surface by a distance equal to the radius of curvature of the tool surface in the direction of one principal meridian while the second axis is spaced from the vertex by a distance equal to the radius of curvature of the tool surface in the direction of the second principal meridian. Accordingly, as the tool in Rupp is orbitally driven, its lapping surface will automatically define and always move along a toroidal surface in space. The tool is mounted such that the orbital motion applied to it will continuously change in amplitude between upper and lower limits. This causes the tool to describe a spiral pattern relative to the lens surface which will insure that different parts of the tool will be contacting different parts of the lens at all times.

In U.S. Pat. No. 3,389,508, issued June 25, 1968 to Suddarth, et al., a lens blank supporting structure receives an orbiting movement while a "break-up" movement is provided by the lens lap. In U.S. Pat. No. 3,824,742, issued July 23, 1974 to Rupp, the tool is moved across the lens in a compound motion consisting of an oscillating movement in a first curve path having a radius equal to the radius of curvature desired in the direction of one major meridian of the surface coupled with a sweeping movement in a second curved path having a radius equal to the radius of curvature desired in the direction of the second major meridian of the surface. The tool is aligned relative to the lens surface such that the oscillating movement will be within a plane parallel to the tool axis such that substantially the entire abrasive surface of the tool will operate on the lens surface. In U.S. Pat. No. 3,892,092, issued July 1, 1975 to Keith, a first and second eccentric drive means are provided acting through one end of a drive arm which is movable both pivotally and axially and is connected at its outer end with a workpiece holder so as to move the workpiece through a multi-directional path over a flat horizontal polishing surface. One of the eccentric drive means imparts a relatively high speed circular motion to an inner end of the drive arm while the other drive means imparts a relatively low speed circular motion thereto, the composite of such motions providing the "break-up" motion desired. In U.S. Pat. No. 3,893,264, issued July 8, 1975 to Behnke, the polishing tool is moved through an orbit which describes substantially an ellipse while the lens is moved through an orbit which describes a circle in the same plane. Other prior art mechanisms for producing "break-up" movements are disclosed in U.S. Pat. No. 2,159,620 and U.S. Pat. No. 2,168,843.

Still another means for providing a "break-up" motion is disclosed in U.S. Pat. No. 3,732,647, issued May 15, 1973 to Stith. In Stith, the lens is moved laterally while the lapping tool is moved through a complex motion generated by two separate motors and a series of belts, eccentrics, and rods. While Stith in theory provides a satisfactory "break-up" motion, it requires careful alignment and adjustment at frequent periodical intervals.

Previous polishing machines share the common disadvantage of requiring many adjustments before being able to produce an acceptable finish on the workpiece. Furthermore, previous devices have a substantial number of components and are time consuming to service. Additionally, the previous machines which provide a good quality finish to a lens are fairly large, and therefore, take up a lot of space and are difficult to move.

What is needed, therefore, is a compact, modular, and easily serviceable lens polishing machine providing a high quality polished finish.

SUMMARY OF THE PRESENT INVENTION

The present invention provides an apparatus for finishing the surface of a curved workpiece and particularly for finishing an ophthalmic lens.

The apparatus of the present invention has a main frame. A shaft is fastened to the main frame at an intermediate location along the shaft by a universal fastening means whereby the shaft may pivot with two axes of freedom. Eccentric drive means are interconnected with one end of the shaft to drive that end of the shaft around a first predetermined circular path so as to indirectly rotate the opposite end of the shaft around a second predetermined circular path. A mounting device is provided at the opposite end of the shaft, preferably for mounting the lens polishing tool.

The apparatus of the present invention further includes a carrier slidably mounted to the frame such as to be reciprocable along a predetermined path perpendicular to the orbital axis of the shaft and facing the lens polishing tool. A second mounting device, preferably for mounting an ophthalmic lens to be polished or otherwise finished, is reciprocably interconnected with the carrier such as to be reciprocable towards and away from the first mentioned mounting device. The second mounting means are biased towards the first mounting means so as to bias the lens against the finishing tool.

The apparatus of the present invention further includes reciprocable drive apparatus for reciprocating the carrier. The reciprocating motion of the carrier combined with the orbital motion of the shaft results in a pseudo-random or "break-up" motion for finishing the lens.

In the preferred embodiment, the reciprocable drive apparatus and the eccentric drive apparatus are driven by a common power means but at different speeds. The ratio of the cycle speeds of the two drive apparatuses is chosen so that these drive means must undergo a substantial number of cycles before the polishing pattern is repeated.

A principal object of the present invention is to provide a relatively inexpensive and reliable workpiece finishing apparatus and particularly to provide an inexpensive and reliable lens finishing apparatus.

Another important object of this invention is to provide a compact and lightweight workpiece finishing apparatus and particularly a compact and lightweight lens finishing apparatus.

Another important object of the present invention is to provide a modular and easily serviceable apparatus of the above mentioned type.

The many objects, features, and advantages of the present invention will become apparent to those skilled in the art when the following detailed description is read together with the accompanying drawings.

BRIEF DESCRIPTION OF THE DRAWINGS

FIG. 2 is a side elevational view thereof with parts cut away and parts removed;

FIG. 9 is a partial top view of the lens mounting apparatus of the lens polishing and finishing apparatus of FIG. 1.

DETAILED DESCRIPTION OF THE PREFERRED EMBODIMENT

Figure 3:
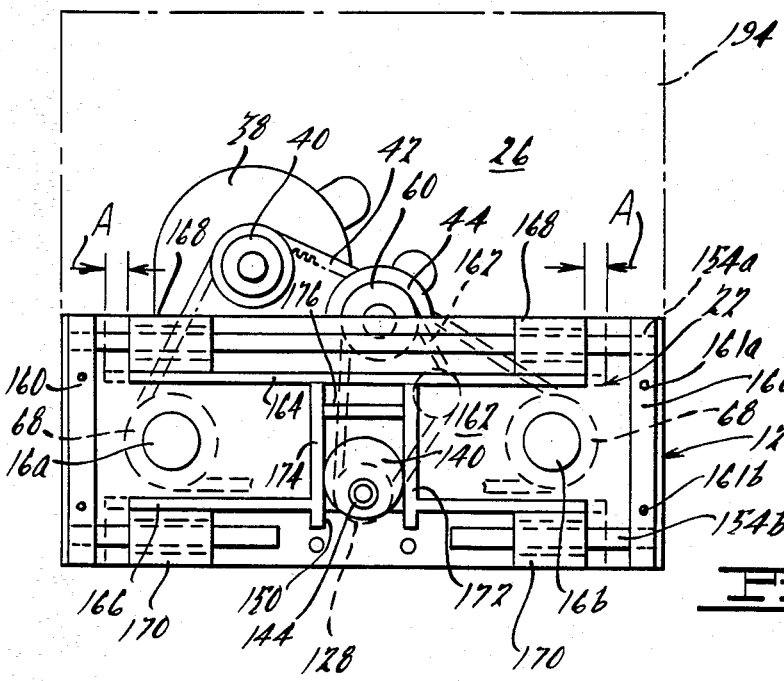
FIG. 3 is a somewhat schematic front elevational view thereof with parts removed.
Figure 4:
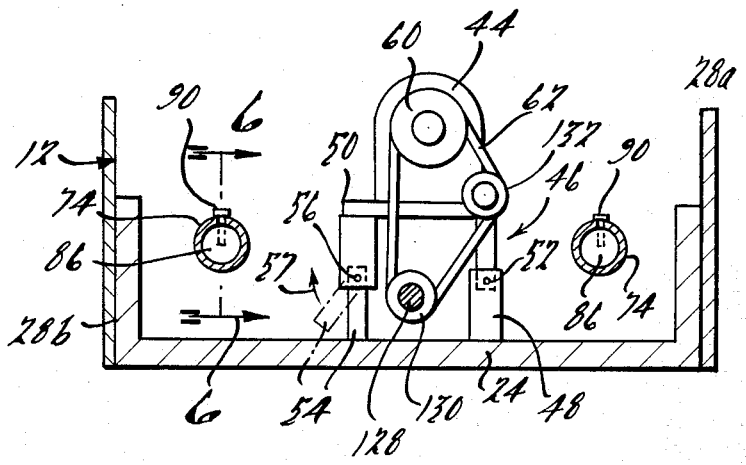
FIGS. 4 and 5 are sectional views taken along lines 4—4 and 5—5, respectively of FIG. 2.
Figure 1:
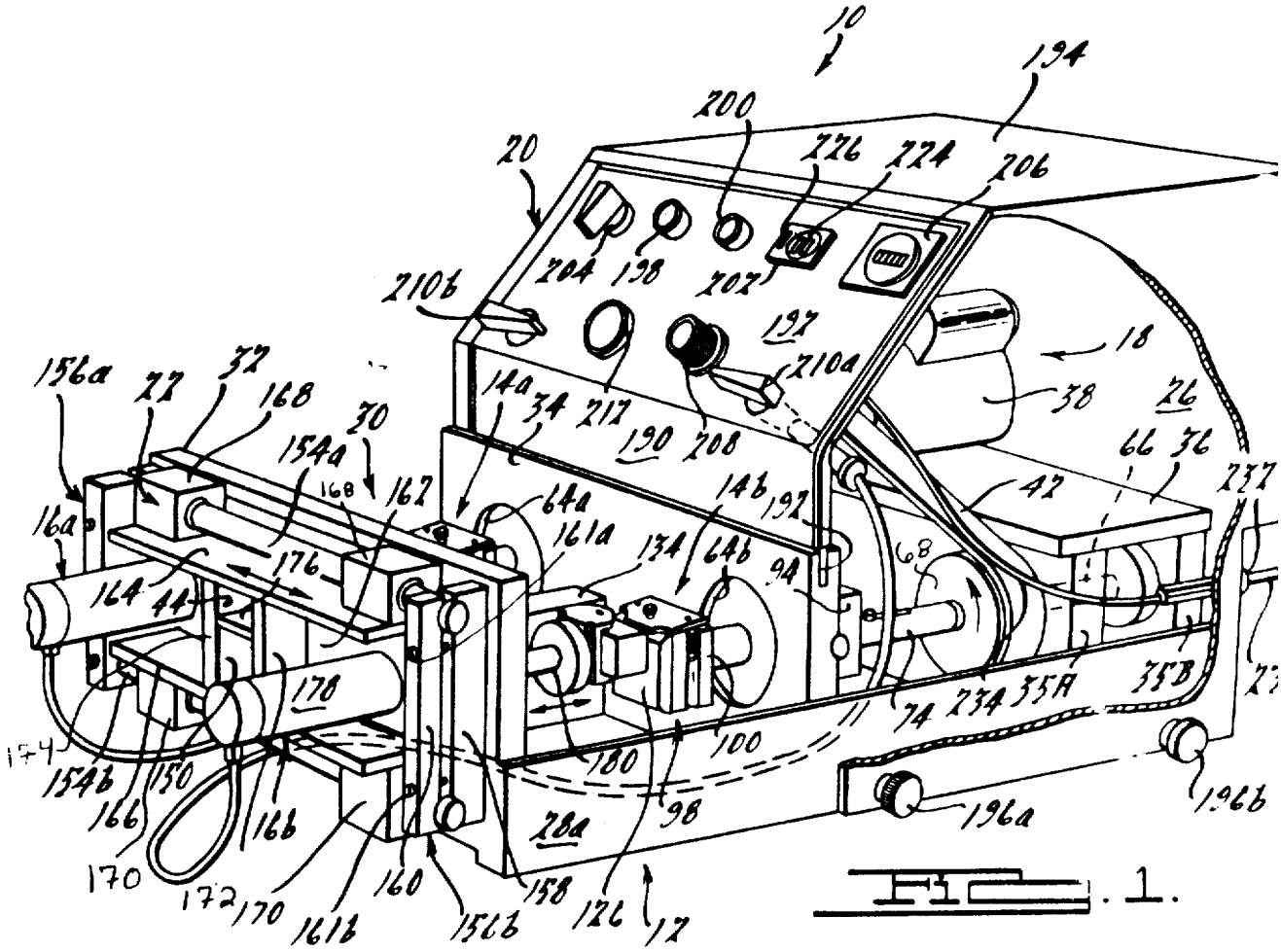
FIG. 1 is a perspective view, with parts cut away, of the lens polishing and finishing machine of the present invention.
Figure 7:
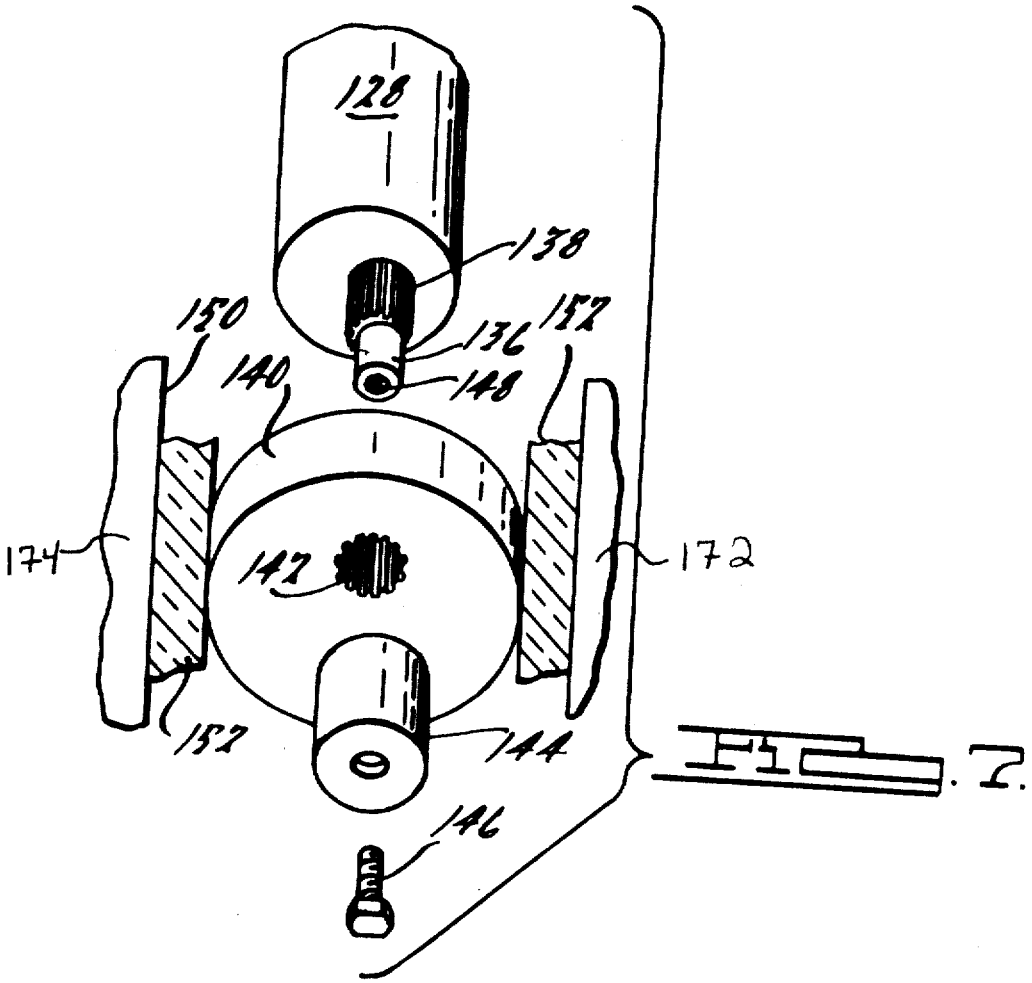

Referring now to FIG. 1, an example of a lens polishing apparatus 10 according to the present invention is illustrated. The lens polishing apparatus 10 has a main frame 12, two polishing tool orbiting subassemblies 14*a* and 14*b*, two lens support sub-assemblies 16*a* and 16*b*, a drive apparatus 18, a control panel sub-assembly 20, and a polishing tool carrier 22. Each of these sub-assemblies will be described in detail below. The main frame 12 of the lens polishing apparatus 10 is illustrated, in part, in FIGS. 1 through 5. In the preferred embodiment, the main frame 12 is a unitary member, and is preferably formed of cast metal. The main frame 12 has a bottom wall 24 (FIG. 4) defining thereabove a drive and control compartment 26. Side walls 28*a* and 28*b* extend upwardly from the bottom wall 24 and forwardly therefrom, as shown in FIG. 4 and define therebetween a lens polishing compartment 30 forward of the drive control compartment 26 as shown in FIGS. 1 and 2. The main frame 12 further has a front wall 32 and an intermediate wall 34 extending between the side walls 28*a* and 28*b* on either side of the lens polishing compartment 30.

The drive apparatus 18 is provided within the drive and control compartment 26. The drive apparatus includes a motor 38 mounted to a platform 36 having support walls 35*a* and 35*b* (FIGS. 1 and 2) each extending upwardly from the bottom wall 24 of the main frame 12. The motor 38 drives a toothed wheel 40 which, through a timing belt 42, drives the carrier 22 and the polishing tool orbiting sub-assemblies 14*a* and 14*b*.

A gear reduction box 44, well known in the art and, therefore, not shown in detail in the drawing, is also provided within the drive and control compartment 26. The gear reduction box is mounted on a separate platform 46, forward of the platform 36 for the motor. The platform 46 includes a partial support wall 48 extending upwardly from the bottom wall 24 of the main frame 12. A table top 50 is pivotally interconnected near one of it's edges to the support wall 48, as shown at 52. A second support 54, for example a U-shaped stamping, is pivotally fastened as shown at 56, to the table top 50 near the opposite edge of the table top from the partial support wall 48. The second support 54 may, therefore, be selectively pivoted away from the bottom wall 24, as indicated by arrow 57 in FIG. 4, thereby permitting the platform 46 to be pivoted downwardly around the pivot point at 52. The gear reduction box 44 is provided with a toothed wheel 58 (FIGS. 2 and 5) which is driven by the timing belt 42 in a manner to be described below. The gear reduction box is also provided with a second toothed wheel 60 (FIGS. 3 and 4) driven by the gear reduction box at a predetermined multiple of the speed of the toothed wheel 58. The second toothed wheel 60 drives a second timing belt 62, described later, for driving the polishing tool carrier 22.

Figure 5:
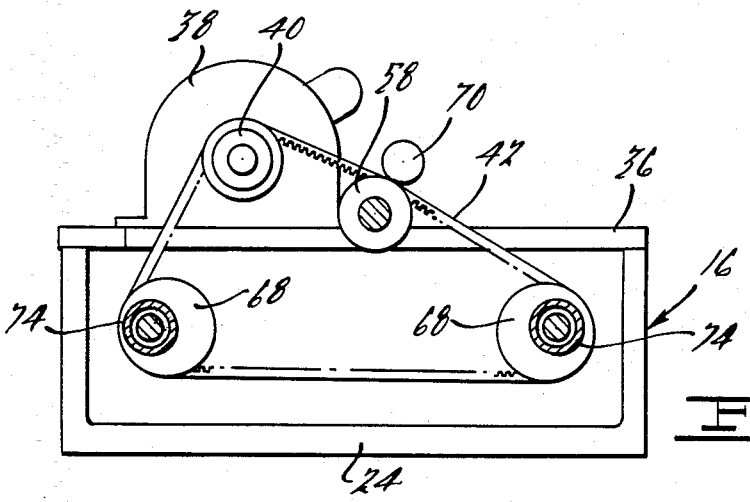

Each of the polishing tool orbiting sub-assemblies 14*a* and 14*b* are partially located within the drive and control compartment 26 and extend, through respective apertures 64*a* and 64*b* into the lens polishing compartment 30, as best shown in FIG. 1. Each polishing tool orbiting sub-assembly 14*a* or 14*b* includes a first shaft 66 (FIGS. 1 and 2) rotatably mounted to the main frame 12 with its longitudinal axis perpendicular to the intermediate wall 34. As shown in FIG. 2, each first shaft 66 is passed through suitable bearings or bushings in the support walls 35*a* and 35*b* of the platform 36 and extends a short distance forward of the platform 36. A toothed wheel 68 is interconnected with the free end of each shaft 66. As best shown in FIGS. 3 and 5, the timing belt 42 extends around the toothed wheel 40 of the motor 38, the toothed wheel 58 of the gear reduction box 44 and the toothed wheels 68 of the lens orbiting sub-assemblies 14*a* and 14*b*. A pressure wheel 70 maintains the timing belt 42 in engagement with the toothed wheel 58. The timing belt 42 may be removed and replaced by pivoting the gear reduction box platform 46 out of the way, as described previously.

Figure 6:
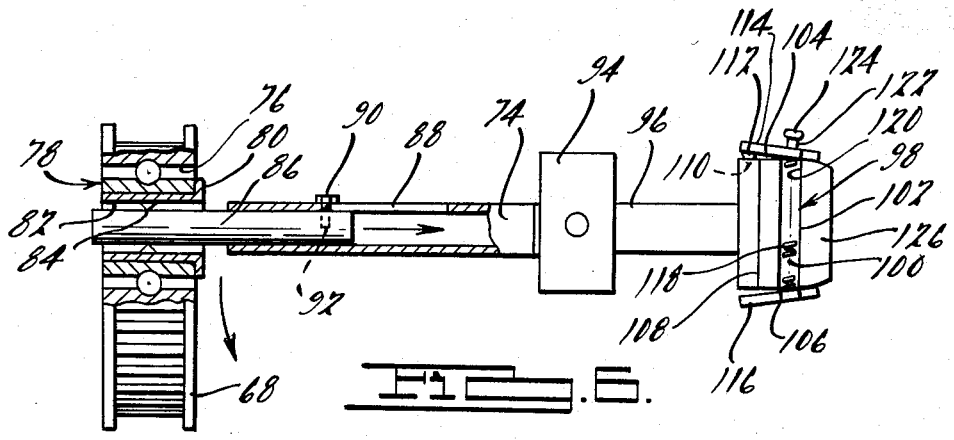
FIG. 6 is a cutaway side view of one of the lens tool orbiting apparatuses, taken approximately along line 6—6 of FIG. 4.

Further details of the lens orbiting sub-assemblies 14*a* and 14*b* are shown in FIGS. 1, 2, 4, 5 and 6. Each of the lens orbiting sub-assemblies includes a shaft 74 pivotally and eccentrically mounted to the associated toothed wheel 68 and extending forward therefrom through the apertures 64*a* or 64*b* into the lens polishing compartment 30. The manner in which each shaft 74 is interconnected with its associated wheel 68 is illustrated in FIG. 6 for one of the polishing tool orbiting sub-assemblies 14*a* or 14*b*. An eccentrically disposed aperture 76 is provided in the toothed wheel 68. A ball bearing assembly 78 is fitted into the aperture 76. A bushing 80, preferably formed of urethane, is pressed into the ball bearing assembly 78. The bushing 80 has an internal bore 82 and an inwardly oriented annular ridge 84 centrally located therein.

The shaft 74 is hollow and is provided with a stub shaft 86 slidably inserted into the end thereof adjacent to the toothed wheel 68. The shaft 74 is further provided with a longitudinally extending slot 88. A screw or similar fastener 90 is passed through the slot 88 and is threaded into an internally threaded bore 92 in the stub shaft 86. The free end of the stub shaft 86 is removably inserted into the bushing 80. The outer diameter of the stub shaft 86 is approximately the same as the inner diameter of the annular ridge 84 so that the stub shaft 86 may pivot thereon. In use, the screw 90 is tightened so as to rigidly secure the stub shaft 86 to the shaft 74 with the stub shaft 86 inserted in the bushing 80. For servicing, however, the screw 90 is loosened and the stub shaft may be retracted from the bushing 80 by sliding the screw 90 along the slot 88.

As previously mentioned, an intermediate portion of each shaft 74 passes through an aperture 64*a* or 64*b* in the intermediate wall 34. The intermediate portion of the shaft 74 is secured in position relative to the intermediate wall 34 by means of a joint 94, not shown in detail in the drawing but well known in the art. The joint 94 may be characterized as a universal joint in that two axes of pivotal freedom are permitted between the shaft 74 and the intermediate wall 34. The joint 94, however, should be selected so as to prohibit rotation of the shaft 74 around its longitudinal axis and so as to prohibit reciprocation of the shaft 74 through the associated apertures 64*a* or 64*b*. An example of a joint well known in the art which may be satisfactorily used for the joint 94 is a Cardon Joint. However, other joints having similar characteristics may be used as will be apparent to those skilled in the art.

As indicated above, an end 96 of each shaft extends into the lens polishing compartment 30. A lens polishing tool mounting apparatus 98 is provided at the end 96 of the shaft 74, as illustrated in FIGS. 1, 2 and 6. Each polishing tool mounting apparatus 98 includes a mounting block 100 fixedly interconnected with the shaft 74. The mounting block 100, as shown in FIG. 6, has a front surface 102, an upper surface 104, and a lower surface 106. The mounting block 100 also has two side surfaces 108, only one of which is shown in FIG. 6. The upper surface 104 is provided with two indentations 110 in which two ball bearings 112 are partially inserted. An upper plate 114 rests partly on the ball bearings 112 and the upper surface 104 of the mounting block 100. A lower plate 116 is provided adjacent to the lower surface 106 of the mounting block 100 and is secured thereto by springs 118 extending on either side of the mounting block between the upper plate 114 and the lower plate 116. Each spring 118 is partly located in a semi-cylindrical channel 120 and the associated side surface 108 of the mounting block 100. A stud 122 is fastened to the upper plate 114 and extends upwardly therefrom having a head 124 spaced a predetermined distance above the upper plate. The upper plate 114 may, therefore, be selectively pivoted on the ball bearings 112 away from the upper surface 104 of the mounting block 100 by use of a claw, not shown in the drawing but well known in the art.

A lens polishing block or tool 126 is removably interconnected with the polishing tool mounting apparatus 98 by temporarily pivoting the upper plate 114 upwardly as described above and inserting the block lens polishing 126 between the upper plate 114 and the lower plate 116 against the front surface 102 of the mounting block 100. When the upper plate 114 is released, the springs 118 bias the plates upper and lower 114 and 116 together and thereby secure the lens polishing block 126 between the forward most edges thereof.

It is, therefore, readily apparent that, when the motor 38 is operating, the toothed wheel 68 is rotated at a predetermined constant speed so as to cause the ends of the shaft 74 to move around predetermined circular paths. Thus, the lens polishing tool 126 is caused to move in a conical orbit around a predetermined orbital axis. Since the main frame 12 is formed of a single structure, the apertures 64*a* and 64*b* may be accurately aligned with the first shift 66 and, therefore, the joint 94 may also be easily aligned with the shaft 66. Thus, the orbital axis of the lens 126 will be substantially aligned with the longitudinal axis of the first shaft 66. No off axis adjustment will be necessary as a result of this design.

Referring now generally to FIGS. 2 through 4, a portion of the apparatus for reciprocating the carrier 22 may be seen. A power or drive shaft 128 for the carrier reciprocation apparatus is rotatably mounted to the main frame 12 so as to extend from the drive and control compartment 26 through suitable apertures in the intermediate wall 34 and the front wall 32 of the main frame and to extend forward therefrom. Suitable bushing or bearing means are provided in the intermediate wall 34 in the front wall 32 for the power shaft 128. The end of the power shaft 128 within the drive and control compartment 26 is interconnected with a toothed wheel 130 (FIGS. 2 and 4). The second timing belt 62 extends around the second toothed wheel 60 on the reduction gear box 44 and the toothed wheel 130 on the end of the shaft 128 as well as around an idling toothed wheel 132 rotatably mounted to the table top 50. The second timing belt 62 may be removed from the toothed wheels 130, 132 and 60 by pivoting the table top platform 50 downwardly as described earlier.

The intermediate portion of the power shaft 128 is enclosed within a tunnel 134 formed integrally with the main frame 12 so as to shield the power shaft 128 from the lens polishing compartment.

Figure 7:
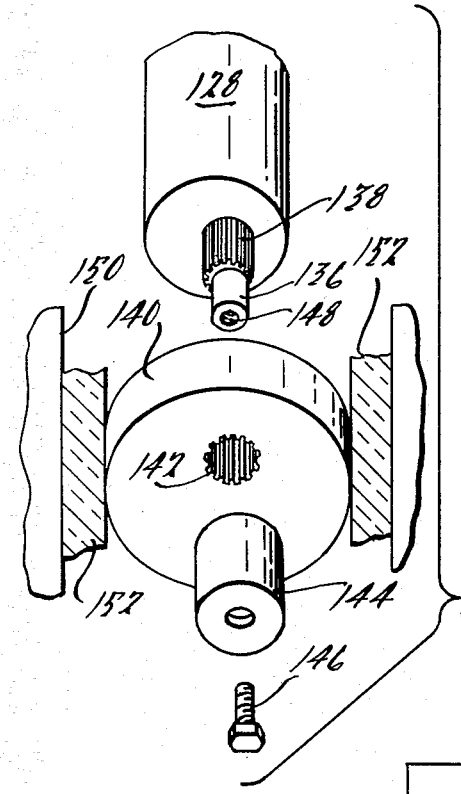
FIG. 7 is a exploded view of a portion of the carrier reciprocating apparatus of the lens polishing apparatus of FIG. 1.
Figure 8:
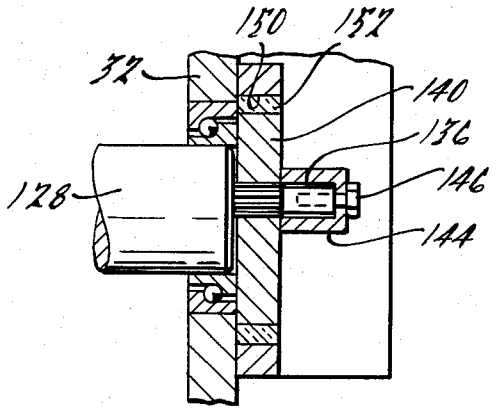
FIG. 8 is a sectional view through the reciprocating apparatus of FIG. 7.

As shown in FIG. 7, an eccentrically disposed post 136 extends from the end of the power shaft 128 opposite the toothed wheel 130 (not shown). A plurality of equally spaced radial flutes 138 are disposed around the lower portion of the post 136. A drive wheel 140 is provided with an eccentrically located fluted aperture 142 selectively engageable with the flutes 138 of the post 136. A portion of the post 136 extends through the aperture 142 and is removably inserted into a cap 144. A screw 146 is passed through an aperture in the cap 144 and engages a threaded bore 148 in the end of the post 136 to secure the cap 144 and the wheel 140 to the power shaft 128. It is readily apparent that the amount of eccentric motion of the drive wheel 140 relative to the drive shaft 128 may be selectively adjusted by temporarily separating the drive wheel from the drive shaft, rotating the drive wheel relative to the drive shaft and by angular displacement corresponding to one or more of the flutes 138, and refastening the drive wheel to the drive shaft. In the preferred embodiment, the longitudinal axis of the post 136 is offset by one eighth of an inch ($\frac{1}{8}$ in.) from the longitudinal axis of the drive shaft 128 and the longitudinal axis of the fluted aperture 142 is offset by three sixteenths of an inch (3/16 in.) from the longitudinal axis of the drive wheel 140. Thus, the eccentricity of the longitudinal axis of the drive wheel 140 relative to the drive shaft 128 may be adjusted to within a range of one eighths of an inch ($\frac{1}{8}$ in.) to five eighths of an inch ($\frac{5}{8}$ in.) of movement. The drive wheel 140 is trapped within an aperture 150 in the carrier 22 and drives the carrier to reciprocate in a manner to be described shortly. Shims 152 may be provided between the walls of the aperture 150 and the drive wheel 140, if needed, to correct any misalignment due to tolerance build-ups. In the preferred embodiment, however, the shims 152 are only added due to wear of these components if necessary.

The structure of the carrier 22 is best shown in FIGS. 1 and 3. The carrier is removably mounted on two guide rods 154*a* and 154*b* (FIGS. 1 and 2). The guide rods 154*a* and 154*b* are rigidly interconnected with the front wall 32 of the main frame 12 in a co-planar spaced apart relationship so as to be spaced a predetermined distance ahead of the front wall 32 by means of rod support structures 156*a* and 156*b*. Each rod support structure 156*a* or 156*b* consists of a partial vertical wall 158 extending forward from the front wall 32 of the main frame 12 and a rod clamping member 160 secured thereto by bolts 161*a* and 161*b*. The carrier 22, like the main frame 12, is preferably a unitary structure formed of a cast metal. The carrier 22 is provided with a first wall 162 disposed parallel to the front wall 32 of the main frame 12. The carrier 22 also has an upper wall 164 and a partitioned lower wall 166 extending forwardly from the first wall 162 in a spaced parallel relationship between the guide rods 154*a* and 154*b*. The carrier 22 is further provided with two rod engagement portions 168 extending upwardly from the upper wall 164 to engage the guide rod 154*a* and two similar rod engagement portions 170 extending downwardly from the lower wall 166 for engagement with the rod 154*b*. Each of the rod engaging portions is provided with a suitable bushing or bearing surface.

The carrier 22 is also provided with vertical walls 172 and 174 extending outwardly from the first wall 162 between the upper wall 164 and the lower wall 166 on either side of the drive wheel 140. The space between the vertical walls 172 and 174 defines the apertures 150 referred to above cooperating with the drive wheel 140 to reciprocate the carrier 22. An additional small horizontal wall 176 is provided between the vertical walls 172 and 174 and between the drive wheel 140 and the upper wall 164.

The two polishing tool lens support or sub-assemblies 16*a* and 16*b* are interconnected with the first wall 162 of the carrier 22, one of the lens support sub-assemblies being located on either side of the vertical walls 172 and 174. Each of the lens support sub-assemblies includes a non-rotational cylinder 178 and piston 180. The cylinder and piston may be selected from many well known in the art. The cylinder 178 is fixedly secured to the first wall 162 of the carrier 22 by any appropriate means. The piston 180 extends from the cylinder 178 through appropriate apertures in the first wall 162 of the carrier 22 and in the front wall 32 of the main frame 12 towards the lens polishing tool 126. When the cylinder 178 is supplied with pressurized air, in a manner to be described later, the piston 180 is biased by the air pressure in the cylinder 178 towards the polishing tool 126. A lens holder 182, also well known in the art, is pivotally fastened by means of a vertically disposed pivot pin 184 to the free end of the piston 180, as shown in FIG. 9. A lens, not shown in the drawing, may be mounted in the lens holder 182 as is well known in the art.

When the motor 38 is operating and the cylinder 178 is supplied with pressurized air, the lens holder 182, and, therefore, the lens, is pressed against the lens polishing tool 126. The lens, in its central position, illustrated in FIG. 3, is aligned with the orbital axis of the lens polishing tool 126 and is reciprocated by a predetermined distance A at either side of alignment with the lens polishing tool by the eccentric drive wheel 140. As mentioned above, the predetermined distance A may be easily adjusted to within a range of five eighths of an inch to one eighth of an inch ($\frac{5}{8}$ in.–$\frac{1}{8}$ in.) in the preferred embodiment. Furthermore, when the motor 38 is operating, the lens polishing tool 126 is orbited by the orbiting sub-assembly 14*a* or 14*b* described above. The side to side reciprocating motion of the lens combined with the orbital motion of the lens polishing tool 126 provides the desired "break-up" motion between the lens and the lens polishing tool. By an appropriate selection of a reduction ratio in the gear reduction box 44, the cycle speeds of the reciprocation of the carrier 22 and the cycle speed of the orbiting polishing tool 126 may be so proportioned as to cause locations on the lens polishing tool 126 to define a varying figure eight pattern on the lens being polished. If, for example, the cycle speed of the carrier 22 is A cycles per second and the cycle speed of the polishing tool 126 is B cycles per second, it is desirable that the ratio between A and B be chosen such that a substantial number of cycles, and therefore, a substantial amount of time will pass before the lens polishing tool 126 and the lens repeat the same pattern. The pattern will not repeat at all during the normal polishing time for a single lens.

Figure 10:
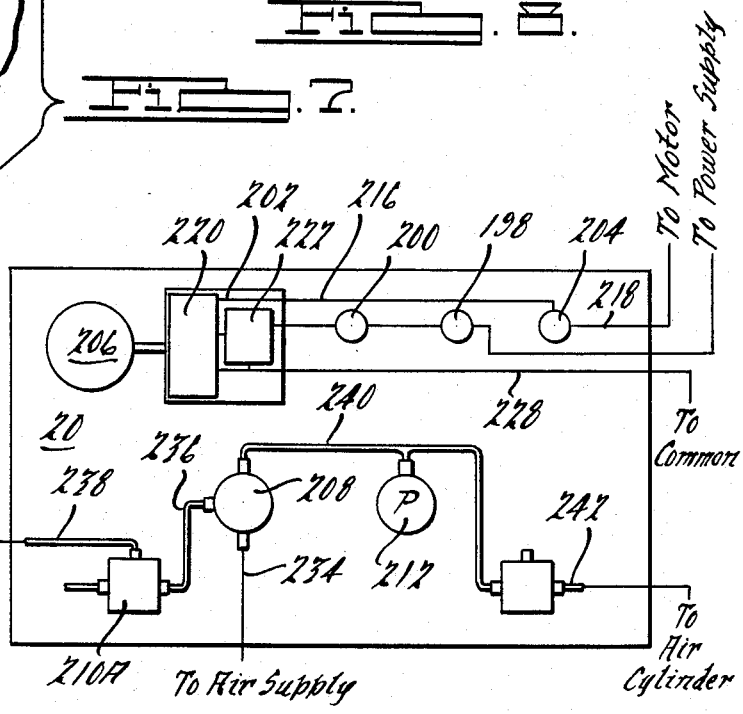
FIG. 10 is a schematic diagram illustrating, in part, the mechanical, electrical, and pneumatic arrangement of the control panel of the lens polishing apparatus of FIG. 1.

The control apparatus of the present invention will now be described in detail. Referring to FIGS. 1, 2, and 10, the control panel 20 for the lens polishing machine of the present invention is shown. The control panel 20 illustrated is formed of a sheet metal stamping having a first portion 190 (FIGS. 1 and 2) and removably inserted in a slot 192 in the upper edge of the intermediate wall 34 of the main frame 12. The control panel 20 further has a second portion extending upwardly and angularly from the first portion 190 at a convenient angle so as to facilitate visibility and accessibility of the controls. The control panel 20, therefore, forms, together with the intermediate wall 34 of the main frame 12, a front wall and a partial top wall for the drive and control compartment 26. A cover 194 formed of a lightweight plastic material or of a sheet metal stamping completes the housing enclosing the drive and control compartment 26. The cover 194 may be secured to the side walls 28*a* and 28*b* of the main frame 12 by means of manually operable threaded fasteners 196*a* and 196*b*.

As illustrated in a respective front view in FIG. 1 and in a schematic rear view in FIG. 10, several conventional control elements 198 through 212 are provided on the upper portion 192 of the control panel 20. Each of these elements are well known in the art and commercially available and are therefore not illustrated or described in detail. The control panel elements 198 through 206 form parts of an electronic control circuit, described below. The control panel elements 208 through 212 are components of a pneumatic circuit for the control of the lens supporting sub-assemblies 16*a* and 16*b*, described shortly.

The motor control circuit, shown in part in FIG. 10, includes a power supply, not shown, interconnected with a line 214 to a start button 198, on abort button 200 and a timer 202. The timer is interconnected, by a line 216 with a three-way switch 204, having an off, low speed, and a high speed position, for controlling the motor 38. A line 218 interconnects the switch 204 with the motor 38. As is well understood in the art, the motor 38 is either grounded or connected to the opposite pole of the power supply from the line 214. The timer 202 is also interconnected by a line 228 with the common side of the transformer. The timer 202 includes a timer switch 220 and a timer logic circuit 222 for controlling the operation of the motor. The timer 202 also includes a clock or counter 224 and a control knob 226 for setting the clock 224. The control circuit is designed, and the timer logic switch 222 is selected, so that the motor 38 will not operate unless the three-way switch 204 is set on one of the operating positions, the timer is set to a cycle time in excess of zero (0), and the start button 198 is depressed. Once the motor is started, the clock 224 indicates the remaining cycle time before the motor is automatically stopped. The motor may be prematurely stopped by either pressing the abort button 200, switching the motor control switch to the off position, or by manually resetting the timer to zero (0). If the operation of the motor 38 is prematurely aborted by either of the first two mentioned methods, the timer remains set for the time remaining at the time of the premature abortion of the operation. An accumulative clock 206 is connected with the timer 202 so as to maintain a record of total machine use time. A quick disconnect interconnector, not shown in the drawing but well known in the art, may be provided along the lines 218, 214 and 228 so as to facilitate a quick separation of the control panel 20 from the main frame 12 for servicing. Preferably, a single quick disconnect device is used for all three lines.

The details of the pneumatic circuit are partly shown in FIGS. 1 and 10. As shown in FIG. 1, a line 230 leads from a fitting 232 in the cover 194 to an external source of pressurized air, not shown in the drawing. A line 234 leads from the fitting 232 to an air pressure regulator 208 on the control panel 20. A quick disconnect fitting, not shown, is preferably provided where the line 234 connects to the air pressure regulator 208. A line 236 extends from the air pressure regulator 208 to a control valve **210*a* on the control panel 20. A line 238 having a quick disconnect fitting therealong, not shown in the drawing, leads from the control valve 210*a* to the cylinder 178 of the lens supporting sub-assembly 16*a*. A line 240 is also connected to the air pressure regulator and leads to an air pressure gage 212 and a second control valve 210*b* which, in turn, is interconnected by a line 242 to the air cylinder 178 of the other lens supporting sub-assembly 16*b*. Another quick disconnect fitting is provided along the line 242. In the preferred embodiment, the air cylinder is selected having a cross-section of one square inch (1 in.) and a pressure gage 212 is selected so as to read pressure in pounds per square inch so that the gage directly reads the amount of force in pounds exerted upon the lens. It may readily be appreciated, then, that the pressure regulator 208 may be operated to provide a desired pressure, and thereby a desired force on the lens to be polished. The motor may be started, as indicated above, and one or two lenses may be biased against the lens polishing tools 126 by the manual rotation of a control handle for one or both of the control valves 210*a* and 210*b***.

It may readily be appreciated that, if desired, a source of pressurized air may be provided, alternatively, by a compressor located within the drive and control compartment 26.

The remaining components of the lens polishing machine of the present invention are illustrated in FIG. 2. A pan 244 is removably interconnected with the lower side of the main frame 12 below the lens polishing compartment 30 so as to collect debris and fluid therefrom. The pan may be fastened to side walls **28*a* and 28*b* of the main frame 12 by means of spring plates 246 secured by fasteners 248 on opposite sides of the pan 244 and selectively engageable with the outer surfaces of the side walls 28*a* and 28*b*. The pan 244 may also be provided with a drain 250**.

The lens polishing apparatus may further be provided, if desired, with selectively removable side walls 252 for the lens polishing compartment 30. The side walls are removably secured to the main frame 12 by any convenient method. Preferably, the selectively removable side walls 252 are transparent so that the operation of the apparatus may be viewed. Alternatively, and not shown in the drawing, a removable transparent cover may be provided for the lens polishing compartment 30 so as to isolate the lens polishing compartment 30 from the environment during a polishing operation.

The present invention thereby provides a compact, lightweight, and a modular lens finishing apparatus. The apparatus may be easily disassembled for servicing. No alignment is necessary since the alignment is provided by the alignment of apertures in the main frame 12, all of which may be bored in the main frame in two passes.

The above description provides the best mode contemplated by the inventor at the time of filing for carrying out the present invention and is by way of example rather than by way of limitation. Many variations and modifications from the elements described above are within the scope of the present invention and will be apparent to one skilled in the art. The scope of the present invention, therefore, is intended to be limited only by the scope of the claims appended hereto. It should be noted that as used herein, finishing includes grinding, polishing, finishing, lapping and similar operations on appropriate workpieces.

What is claimed as novel is as follows:

1. An apparatus for finishing a surface of a lens with a finishing tool, said apparatus comprising:

a main frame;

a non-rotatable shaft mounted to said main frame, said non-rotatable shaft having a central longitudinal axis, a first end, a second end and an intermediate portion between said first end and said second end;

universal mounting means mechanically interposed said intermediate portion of said non-rotatable shaft and said main frame, said universal mounting means fixing said intermediate portion of said non-rotatable shaft relative to said main frame and pivotally interconnecting said non-rotatable shaft with said main frame, said universal mounting means having a pivot point about which said non-rotatable shaft pivots, said pivot point lying on said central longitudinal axis;

eccentric drive means interconnected with said first end of said non-rotatable shaft to drive said first end of said non-rotatable shaft around a first predetermined circular path, said first predetermined circular path having a center of curvature axially aligned with said pivot point of said universal mounting means such that as said first end of said non-rotatable shaft moves about said first circular predetermined path and said non-rotatable shaft pivots about said pivot point, said second end of said non-rotatable shaft moves in a second predetermined circular path, said motion of said non-rotatable shaft having an orbital axis extending through said pivot point of said universal mounting means, said second predetermined circular path having a center of curvature axially aligned with said pivot point of said universal mounting means;

first means for mounting said finishing tool to said second end of said non-rotatable shaft;

first carrier means spaced a predetermined distance from said second end of said non-rotatable shaft and slidably mounted to said main frame such as to be reciprocable along a predetermined path perpendicular to said orbital axis of said non-rotatable shaft, said perpendicular path of reciprocation further being in a common plane with said orbital axis of said non-rotatable shaft, said pivot point of said universal mounting means, and said centers of curvature of said first and second predetermined circular path;

second carrier means reciprocably interconnected with said first carrier means such as to be reciprocable relative to said first carrier means along a reciprocation axis parallel to said orbital axis of said non-rotatable shaft and having a portion near said second end of said non-rotatable shaft;

reciprocal drive means mechanically interposed said first carrier means and said main frame selectively operable to reciprocate said first carrier means relative to said second predetermined circular path relative to said main frame;

second means for mounting said lens to said portion of said second carrier means near said second end of said non-rotatable shaft, said second mounting means pivotally interconnecting said lens with said second end of said non-rotatable shaft; and biasing means interposed said first carrier means and said second carrier means, said biasing means biasing said second carrier means toward said non-rotatable shaft and, thereby, biasing said second means for mounting towards said first means for mounting; said lens being removably interconnected to one of said mounting means and said finishing tool being removably interconnected to the other end of said tool mounting means, whereby a combination of movements between said lens and said finishing tool is the sum of the orbiting of said non-rotatable shaft about said pivot point of said universal mounting means, and the reciprocable movement of said first carrier means along said predetermined path perpendicular to said orbital axis.

2. The apparatus of claim 1 wherein said main frame further comprises:

a first wall having an aperture therethrough;

a second wall parallel to said first wall and spaced a first predetermined distance therefrom, said second wall having an aperture therethrough; and a lens finishing compartment between said first wall and said second wall; said non-rotatable shaft being fastened by said universal mounting means to said second wall and said first carrier means being slidably fastened to said first wall.

3. The apparatus of claim 2 wherein:

said main frame further comprises a third wall and a fourth wall, said third wall and said fourth wall being parallel to said first wall and said second wall and being spaced a second and a third predetermined distance, respectively, from said first wall, said third and fourth walls having apertures therethrough axially aligned with said aperture in said second wall; and said eccentric drive means further comprises a second shaft rotatably mounted in said apertures of said third wall and said fourth wall, said non-rotatable shaft being eccentrically interconnected with said second shaft.

4. The apparatus of claim 1 wherein said universal mounting means comprises a Cardon Joint.

5. The apparatus of claim 1 wherein said eccentric drive means comprises a toothed wheel rotatably mounted to said main frame, selectively operable power drive means and a drive belt driven by said power drive means and interconnected with said toothed wheel for selectively rotating said tooth wheel; said first end of said non-rotatable shaft being pivotally and eccentrically mounted to said toothed wheel.

6. The apparatus of claim 1 wherein said first end of said non-rotatable shaft is provided with a longitudinal bore and further wherein said eccentric drive means comprises:

a first rotational member rotatably interconnected with said main frame and an eccentrically disposed aperture in said first rotational member;

a stub shaft having one end slidably inserted into said longitudinal bore of said first end of said non-rotatable shaft and an other end selectively insertable into said eccentrically disposed aperture in said first rotational member; and selectively engageable pivotal coupling means for pivotally securing said stub shaft in said aperture.

7. The apparatus of claim 1 wherein said first means for mounting said finishing tool comprises:

a block having a forward face and a back face, said block being rigidly interconnected at said back face to said second end of said non-rotatable shaft;

a first clamping member disposed to one side of said block;

a second clamping member disposed to another side of said block;

biasing means interposed said first clamping member and said second clamping member for biasing said first and second clamping members towards each other and removably securing said first and second clamping members to said block, each of said first and second clamping members having a clamp portion extending forward of said forward face of said block; and said finishing tool being removably securable between said clamp portions.

8. The apparatus of claim 1 further comprising at least one rod interconnected with said main frame, said first carrier means being slidably mounted to said rod.

9. The apparatus of claim 1 wherein said second carrier means further comprises a non-rotational piston having a cylinder and piston, said cylinder being mechanically interconnected with said first carrier means and further being selectively interconnected with a source of pressurized fluid, and said piston having a free end extending therefrom toward said finishing tool said free end being provided with said lens.

10. The apparatus of claim 1 wherein said reciprocal drive means comprises a drive shaft rotatably mounted to said main frame, a drive wheel eccentrically mounted to said drive shaft, and follower means on said first carrier means engaging said drive means.

11. The apparatus of claim 1 further comprising a control panel removably interconnected with said main frame.

12. An apparatus for finishing a surface of a lens with a finishing tool, said apparatus comprising:

a main frame;

a non-rotatable shaft mounted to said main frame, said non-rotatable shaft having a central longitudinal axis, a first end, a second end and an intermediate portion between said first end and said second end;

universal mounting means mechanically interposed said intermediate portion of said non-rotatable shaft and said main frame, said universal mounting means fixing said intermediate portion of said non-rotatable shaft relative to said main frame and pivotally interconnecting said non-rotatable shaft with said main frame, said universal mounting means having a pivot point about which said non-rotatable shaft pivots, said pivot point lying on said central longitudinal axis;

eccentric drive means interconnected with said first end of said non-rotatable shaft to drive said first end of said non-rotatable shaft around a first predetermined circular path, said first predetermined circular path having a center of curvature axially aligned with said pivot point of said universal mounting means such that as said first end of said non-rotatable shaft moves about said first predetermined circular path and said non-rotatable shaft pivots about said pivot point, said second end of said non-rotatable shaft moves in a second predetermined circular path, said motion of said non-rotatable shaft having an orbital axis extending through said pivot point of said universal mounting means, said second predetermined circular path having a center of curvature axially aligned with said pivot point of said universal mounting means;

selectively engageable finishing tool mounting means interconnected to said second end of said non-rotatable shaft; said finishing tool being removably mountable to said finishing tool mounting means;

first carrier means spaced a predetermined distance from said second end of said non-rotatable shaft and slidably mounted to said main frame such as to be reciprocable along a predetermined path perpendicular to said orbital axis of said non-rotatable shaft, said perpendicular path of reciprocation further being in a common plane with said orbital axis of said non-rotatable shaft, said pivot point of said universal mounting means, and said centers of curvature of said first and second predetermined circular paths;

second carrier means reciprocably interconnected with said first carrier means such as to be reciprocable relative to said first carrier means along a reciprocation axis parallel to said orbital axis of said non-rotatable shaft and having a portion near said second end of said non-rotatable shaft;

reciprocal drive means mechanically interposed said first carrier means and said main frame selectively operable to reciprocate said first carrier means relative to said second predetermined circular path relative to said main frame;

selectively engageable lens mounting means pivotally interconnected with said portion of said second carrier means near said second end of said non-rotatable shaft, said selectively engageable lens mounting means pivotally interconnecting said lens with said second end of said non-rotatable shaft; said lens being removably mountable to said lens mounting means; and biasing means interposed said second carrier means and said first carrier means, said biasing means biasing said second carrier means toward said non-rotatable shaft and, thereby, biasing said lens against said finishing tool.

13. The apparatus of claim 12 wherein said first end of said non-rotatable shaft is provided with a longitudinal bore and further wherein said eccentric drive means comprises:

a first rotational member rotatably interconnected with said main frame and an eccentrically disposed aperture in said first rotational member;

a stub shaft having one end slidably inserted into said longitudinal bore of said first end of said non-rotatable shaft and an other end selectively insertable into said eccentrically disposed aperture in said first rotational member; and selectively engageable pivotal coupling means for pivotally securing said stub shaft in said eccentrically disposed aperture.

14. The apparatus of claim 1 wherein said main frame further comprises:

three parallel and spaced apart walls;

axially aligned apertures in each of said walls;

a second shaft rotatably mounted in said apertures in adjacent walls of said three walls;

said non-rotatable shaft being pivotally mounted in the aperture in said third wall; and said first end of said non-rotatable shaft being eccentrically and pivotally interconnected with said second shaft.

15. An apparatus for finishing a surface of a lens with a finishing tool, said apparatus comprising:

a main frame comprising:

a first wall having an aperture therethrough;

a second wall parallel to said first wall and spaced a predetermined distance therefrom, said second wall having an aperture therethrough; and a lens finishing compartment between said first wall and said second wall;

a first non-rotatable shaft mounted to said main frame, said first non-rotatable shaft having a central longitudinal axis, a first end, a second end and an intermediate portion between said first end and said second end;

universal mounting means mechanically interposed said intermediate portion of said first non-rotatable shaft and said first wall, said universal mounting means fixing said intermediate portion of said first non-rotatable shaft relative to said main frame and pivotally interconnecting said first non-rotatable shaft with said first wall with said second end of said first non-rotatable shaft extending into said lens finishing compartment, said universal mounting means having a pivot point about which said first non-rotatable shaft pivots, said pivot point lying on said central longitudinal axis;

eccentric drive means interconnected with said first end of said first non-rotatable shaft to drive said first end of said first non-rotatable shaft around a first predetermined circular path said first predetermined circular path having a center of curvature axially aligned with said pivot point of said universal mounting means such that as said first end of said first non-rotatable shaft moves about said first predetermined circular path and said first non-rotatable shaft pivots about said pivot point, said second end of said first non-rotatable shaft moves in a second predetermined circular path, said motion of said first non-rotatable shaft having an orbital axis extending through said pivot point of said universal mounting means, said second predetermined circular path having a center of curvature axially aligned with said pivot point of said universal mounting means;

selectively engageable finishing tool mounting means interconnected to said second end of said first non-rotatable shaft; said finishing tool being removably mountable to said finishing tool mounting means;

a carrier slidably mounted to the side of said second wall opposite said lens finishing compartment such as to be reciprocable along a predetermined path perpendicular to said orbital axis of said first non-rotatable shaft, said perpendicular path of reciprocation further being in a common plane with said orbital axis of said first non-rotatable shaft, said pivot point of said universal mounting means, and said centers of curvature of said first and second predetermined circular paths;

a second shaft having a free end and being reciprocally interconnected with said carrier such that said free end is reciprocable through said aperture in said second wall towards and away from said first non-rotatable shaft;

first reciprocal drive means mechanically interposed said second shaft and said main frame selectively operable to reciprocate said second shaft between two extreme positions relative to said second wall, said two extreme positions being on opposite sides of said orbital axis of said first non-rotatable shaft;

selectively engageable lens mounting means pivotally interconnected with said free end of said second shaft, said lens being removably mountable to said lens mounting means;

selectively operable biasing means interposed said second shaft and said carrier for biasing said second shaft towards said first shaft and, thereby, selectively biasing said lens towards said finishing tool; and common drive means selectively operable to simultaneously operate said reciprocal drive means at one cycle speed and said eccentric drive means at a second cycle speed.

16. The apparatus of claim 15 wherein:

said main frame further comprises a third wall and a fourth wall, said third wall and said fourth wall being parallel to said first wall and said second wall and being spaced a second and a third predetermined distance respectively from said first wall, said third and fourth walls having apertures therethrough axially aligned with said aperture in said second wall; and said eccentric drive means further comprises a second shaft rotatably mounted in said apertures of said third wall and said fourth wall, said first non-rotatable shaft being eccentrically interconnected with said second shaft.

17. The apparatus of claim 15 wherein said eccentric drive means comprises a toothed wheel rotatably mounted to said main frame, selectively operable power drive means and a drive belt driven by said power drive means and interconnected with said toothed wheel for selectively rotating said toothed wheel; said first end of said first non-rotatable shaft being pivotally and eccentrically mounted to said toothed wheel.

18. The apparatus of claim 15 wherein said first end of said first non-rotatable shaft is provided with a longitudinal bore and further wherein said eccentric drive means comprises:

a first rotational member rotatably interconnected with said main frame and an eccentrically disposed aperture in said first rotational member;

a stub shaft having one end slidably inserted into said longitudinal bore of said first end of said first non-rotatable shaft and an other end selectively insertable into said eccentrically disposed aperture in said first rotational member; and selectively engageable pivotal coupling means for pivotally securing said stub shaft in said eccentrically disposed aperture.

19. The apparatus of claim 15 wherein said finishing tool mounting means comprises:

a block having a foward face and a back face, and being rigidly interconnected at said back face to said second end of said first non-rotatable shaft;

a first clamping member disposed to one side of said block;

a second clamping member disposed to another side of said block;

biasing means interposed said first clamping member and said second clamping member for biasing said first and second clamping members towards each other and removably securing said first and second clamping members to said block, each of said first and second clamping members having a clamp portion extending forward of said forward face of said block; and said mounting means being removably securable between said clamp portions.

20. The apparatus of claim 15 wherein said carrier further comprises a non-rotational piston having a cylinder and piston, said cylinder being mechanically interconnected with said carrier and further being selectively interconnected with a source of pressurized fluid, and said piston having a free end extending therefrom toward said finishing tool and being provided with said lens mounting means.

21. The apparatus of claim 15 wherein said first reciprocal drive means comprises a drive shaft rotatably mounted to said main frame, a drive wheel eccentrically mounted to said drive shaft, and follower means on said carrier engaging said first reciprocal drive means.

22. The apparatus of claim 15 further comprising a control panel removably interconnected with said main frame.

* * * * *

UNITED STATES PATENT AND TRADEMARK OFFICE

CERTIFICATE OF CORRECTION

PATENT NO. : 4,510,717

DATED : April 16, 1985

INVENTOR(S) : Dewayne J. Sherwin

It is certified that error appears in the above-identified patent and that said Letters Patent is hereby corrected as shown below:

Column 3, line 51, delete "subassemblies" and insert ---- sub-assemblies ----.

Column 5, line 35, delete "Cardon Joint" and insert ---- cardan joint ----.

Column 6, line 1, delete "block".

Column 6, line 2, after "polishing" insert ---- block ----.

Column 6, line 5, delete "plates upper and lower" and insert ---- upper and lower plates ----.

Signed and Sealed this

*Fifteenth* Day of *October 1985*

[SEAL]

*Attest:*

*Attesting Officer*

DONALD J. QUIGG

*Commissioner of Patents and Trademarks—Designate*

UNITED STATES PATENT AND TRADEMARK OFFICE

CERTIFICATE OF CORRECTION

PATENT NO. : 4,510,717

DATED : April 16, 1985

INVENTOR(S) : Dewayne J. Sherwin

It is certified that error appears in the above-identified patent and that said Letters Patent is hereby corrected as shown below:

Column 6, line 6, after "and 116" insert ---- , respectively, ----.

Column 6, line 16, delete "shift" and insert ---- shaft ----.

Column 6, line 17, before "shaft 66" insert ---- first ----. Same line, after "the lens" insert ---- polishing block ----.

Column 6, line 35, before "reduction" insert ---- gear ----.

Column 6, line 36, delete "gear".

Column 6, line 37, before "shaft 128" insert ---- power ----.

Column 9, line 3, delete "on abort" and insert ---- an abort ----.

Column 9, line 19, before "operating" insert ---- two ----.

Column 9, line 60, delete "a pressure" and insert ---- the pressure ----.

In The Claims

Column 10, line 52, delete "non-rotatable shaft" and insert ---- shaft non-rotatable about its longitudinal axis ----.

Column 12, line 18, delete "Cardon Joint" and insert ---- cardan joint ----.

UNITED STATES PATENT AND TRADEMARK OFFICE

CERTIFICATE OF CORRECTION

PATENT NO. : 4,510,717

DATED : April 16, 1985

INVENTOR(S) : Dewayne J. Sherwin

It is certified that error appears in the above-identified patent and that said Letters Patent is hereby corrected as shown below:

Figures 1 and 7 should appear as shown on the attached sheet.

Patent No. 4,510,717 April 16, 1985

Dewayne J. Sherwin

Patent No. 4,510,717 April 16, 1985

Dewayne J. Sherwin